US011439572B2

(12) United States Patent
Briggs et al.

(10) Patent No.: US 11,439,572 B2
(45) Date of Patent: Sep. 13, 2022

(54) TRANS-ABDOMINAL INTRA-GASTRIC TUBE

(71) Applicant: Sanford Health, Sioux Falls, SD (US)

(72) Inventors: Steven Briggs, Sioux Falls, SD (US); Patrick W. Kelly, Sioux Falls, SD (US)

(73) Assignee: Sanford Health, Sioux Falls, SD (US)

( * ) Notice: Subject to any disclaimer, the term of this patent is extended or adjusted under 35 U.S.C. 154(b) by 157 days.

(21) Appl. No.: 16/483,947

(22) PCT Filed: Feb. 6, 2018

(86) PCT No.: PCT/US2018/016979

§ 371 (c)(1),
(2) Date: Aug. 6, 2019

(87) PCT Pub. No.: WO2018/145059

PCT Pub. Date: Aug. 9, 2018

(65) Prior Publication Data

US 2020/0375853 A1 Dec. 3, 2020

Related U.S. Application Data

(60) Provisional application No. 62/454,988, filed on Feb. 6, 2017, provisional application No. 62/466,456, filed on Mar. 3, 2017.

(51) Int. Cl.
*A61J 15/00* (2006.01)

(52) U.S. Cl.
CPC ..... *A61J 15/0042* (2013.01); *A61J 15/0015* (2013.01)

(58) Field of Classification Search
CPC ..... A61B 17/3415; A61F 5/0073; A61J 15/0049; A61J 15/0053; A61J 15/0015;

(Continued)

(56) References Cited

U.S. PATENT DOCUMENTS 3,176,690 A * 4/1965 Doubler ..... A61M 25/02 604/174
4,642,101 A * 2/1987 Krolikowski ..... A61M 25/0606 604/174

(Continued)

FOREIGN PATENT DOCUMENTS

DE 3036192 A1 5/1982
EP 0648512 A1 4/1995

(Continued)

OTHER PUBLICATIONS

A, Gasparetto, Percutaneous gastric tube placement: Comparison of trans-abdominal and trans-oral approach in patients with chronic ascites, Sep. 2018, PubMed, PMID 30220588 (Year: 2018).*

(Continued)

*Primary Examiner* — Nathan R Price
*Assistant Examiner* — Courtney B Fredrickson
(74) *Attorney, Agent, or Firm* — McDonnell Boehnen Hulbert & Berghoff LLP

(57) ABSTRACT

The present disclosure provides a device that includes a tube having a first end and a second end. The device also includes a stopper coupled to a surface of the tube adjacent to the second end of the tube. The stopper is configured to extend radially from the surface of the tube. The device also includes a first rib coupled to the surface of the tube. The device also includes a second rib coupled to the surface of the tube. The first rib and the second rib are positioned opposite one another on the surface of the tube between the first end of the tube and the stopper.

20 Claims, 9 Drawing Sheets

(58) Field of Classification Search
CPC ..... A61J 15/0034; A61J 15/0042; A61G 2210/30
See application file for complete search history.

(56) References Cited

U.S. PATENT DOCUMENTS

| | | | | |
|---|---|---|---|---|
| 5,071,405 | A | 12/1991 | Piontek | |
| 5,549,657 | A | 8/1996 | Stern | |
| 5,693,032 | A * | 12/1997 | Bierman | A61M 25/02 604/174 |
| 6,802,836 | B2 | 10/2004 | Bouphavichith | |
| 7,060,050 | B2 | 6/2006 | Kliem | |
| 8,308,713 | B2 * | 11/2012 | Li | A61M 39/1011 604/535 |
| 8,858,533 | B2 | 10/2014 | Downing | |
| 9,220,395 | B2 * | 12/2015 | Frassica | A61B 1/00137 |
| 2007/0276356 | A1 | 11/2007 | Downing | |
| 2017/0065493 | A1 | 3/2017 | Schwarz | |

FOREIGN PATENT DOCUMENTS

| | | | | |
|---|---|---|---|---|
| WO | 201075032 | A2 | 7/2010 | |
| WO | WO-2016007890 | A1 * | 1/2016 | A61J 15/0026 |

OTHER PUBLICATIONS

International Search Report for corresponding PCT application No. PCT/US2018/016979, dated Jun. 20, 2018.

* cited by examiner

TRANS-ABDOMINAL INTRA-GASTRIC TUBE

CROSS REFERENCE TO RELATED APPLICATION

This application is a U.S. National Phase application of, and claims the benefit of, International (PCT) Application No. PCT/US2018/056071, filed Feb. 6, 2018, which claims priority to (i) U.S. Provisional Application No. 62/454,988 entitled "Trans-Abdominal Intra-Gastric Tube," filed on Feb. 6, 2017, and (ii) U.S. Provisional Application No. 62/466,456 entitled "Trans-Abdominal Intra-Gastric Tube," filed on Mar. 3, 2017, the contents of all of which are hereby incorporated by reference in their entirety.

RELATED APPLICATIONS

This application claims the benefit of priority to (i) U.S. Provisional Application No. 62/454,988 entitled "Trans-Abdominal Intra-Gastric Tube," filed on Feb. 6, 2017, and (ii) U.S. Provisional Application No. 62/466,456 entitled "Trans-Abdominal Intra-Gastric Tube," filed on Mar. 3, 2017, both of which are hereby incorporated by reference in their entirety.

BACKGROUND THE INVENTION

Gastrostomy tubes are used by medical professionals to facilitate delivery of enteral nutrition in critically ill patients who are unable to tolerate receiving nutrition by mouth. Gastrostomy tubes are placed through the abdominal wall into the stomach. Liquid feed is delivered directly through the tube into the stomach thus bypassing the upper digestive system. A conventional design of a gastrostomy tube includes a long tube with a cuffed end that sits within the stomach holding the stomach against the abdominal wall. The tubular portion passes through the abdominal wall and is of sufficient length to facilitate the delivery of liquid feed to the stomach. The external portion of the tube is approximated to the skin by a movable bolster. Gastrostomy tubes may be placed in a patient for several weeks or indefinitely, depending on the needs of each particular patient.

Historically, patients who have gastrostomy tubes would be characterized as having limited activity and mobilization, heavy and prolonged sedation, and those patients who require use of physical restraints by nurses with many years of intensive care unit ("ICU") experience. Today, patients who have gastrostomy tubes may be characterized by frequent mobilization, light to minimal sedation, and no physical restraints provided by nurses with much less ICU experience. On account of this transition in ICU practice, a gastrostomy tube dislodgment event may be more likely.

Dislodgment occurs when forces pull on the long external portion of the tube, which may result in the migration of the cuffed intra-gastric portion of the tube out of the stomach and into the abdominal wall. This migration occurs because the gastrostomy tube cannot be definitively secured to the abdominal wall. The dislodgment may or may not be noticed until the patient becomes critically ill as a consequence of feeds or gastric contents leaking into the abdominal cavity. The consequences of dislodgment may be severe, including but not limited to, major emergency surgery, significant morbidity, prolonged ICU stays, significant increases in healthcare expenditures, and, not uncommonly, death. While recurrent education of caregivers and efforts to increase awareness of gastrostomy tube risks helps prevent such complications, the inherent design of the traditional gastrostomy tube promotes dislodgment on account of the long external segment that lacks an effective anchoring mechanism to the body that will resist dislodgment. Therefore, an improved percutaneously placed trans-abdominal gastric feeding tube may be desirable.

SUMMARY OF THE INVENTION

The present disclosure provides a percutaneously placed tube of variable lumen size with a stopper at the gastric end with a flanged body that integrates with an external locking mechanism to hold the tube at optimal depth and allow redundant external tubes to be excised so as to resist external forces and avoid causing dislodgment.

In particular, in a first aspect, a device is provided that includes: (a) a tube having a first end and a second end, (b) a stopper coupled to a surface of the tube adjacent to the second end of the tube, where the stopper is configured to extend radially from the surface of the tube, (c) a first rib coupled to the surface of the tube, and (d) a second rib coupled to the surface of the tube, where the first rib and the second rib are positioned opposite one another on the surface of the tube between the first end of the tube and the stopper.

In a second aspect, a locking mechanism is provided that includes: (a) a first component having a first end and a second end, the first component comprising: (i) a first depression on a mating face of the first component, (ii) a first protrusion coupled to the mating face of the first component and positioned between the first depression and the first end of the first component, and (iii) a second protrusion coupled to the mating face of the first component and positioned between the first depression and the second end of the first component, and (b) a second component having a first end and a second end, the second component comprising: (i) a second depression on a mating face of the second component, (ii) a first cavity arranged on the mating face of the second compartment and positioned between the second depression and the first end of the second component, where the first cavity is configured to receive the first protrusion, and (iii) a second cavity arranged on the mating face of the second component and positioned between the second depression and the second end of the second component, where the second cavity is configured to receive the second protrusion.

In a third aspect, a cap is provided that includes: (a) a tubular structure having a first end and a second end, where the tubular structure defines a lumen, (b) a flange coupled to the second end of the tubular structure, (c) a first input port coupled to the flange, and (d) a first channel defined in the flange and configured to provide fluid connection between the first input port and the tubular structure.

In a fourth aspect, a kit is provided that includes the device of the first aspect and the locking mechanism of the second aspect.

In a fifth aspect, a kit is provided that includes the locking mechanism of the second aspect and the cap of the third aspect.

In a sixth aspect, a kit is provided that includes the device of the first aspect, the locking mechanism of the second aspect, and the cap of the third aspect.

In a seventh aspect, a system is provided that includes the device of the first aspect coupled to the locking mechanism of the second aspect, where the first protrusion is positioned at least partially within the first cavity, where the second protrusion is positioned at least partially within the second cavity, and where the first depression and the second depression are positioned around the surface of the tube such that the mating face of the first component contacts the mating face of the second component.

In an eighth aspect, a system is provided that includes the device of the first aspect coupled to the locking mechanism of the second aspect, where the first protrusion is positioned at least partially within the first cavity, where the second protrusion is positioned at least partially within the second cavity, where the third protrusion pierces the first rib and is positioned at least partially within the third cavity, where the fourth protrusion pierces the second rib and is positioned at least partially within the fourth cavity, and where the first depression and the second depression are positioned around the surface of the tube such that the mating face of the first component contacts the mating face of the second component.

These as well as other aspects, advantages, and alternatives, will become apparent to those of ordinary skill in the art by reading the following detailed description, with reference where appropriate to the accompanying drawings.

DETAILED DESCRIPTION OF THE INVENTION

Figure 1:
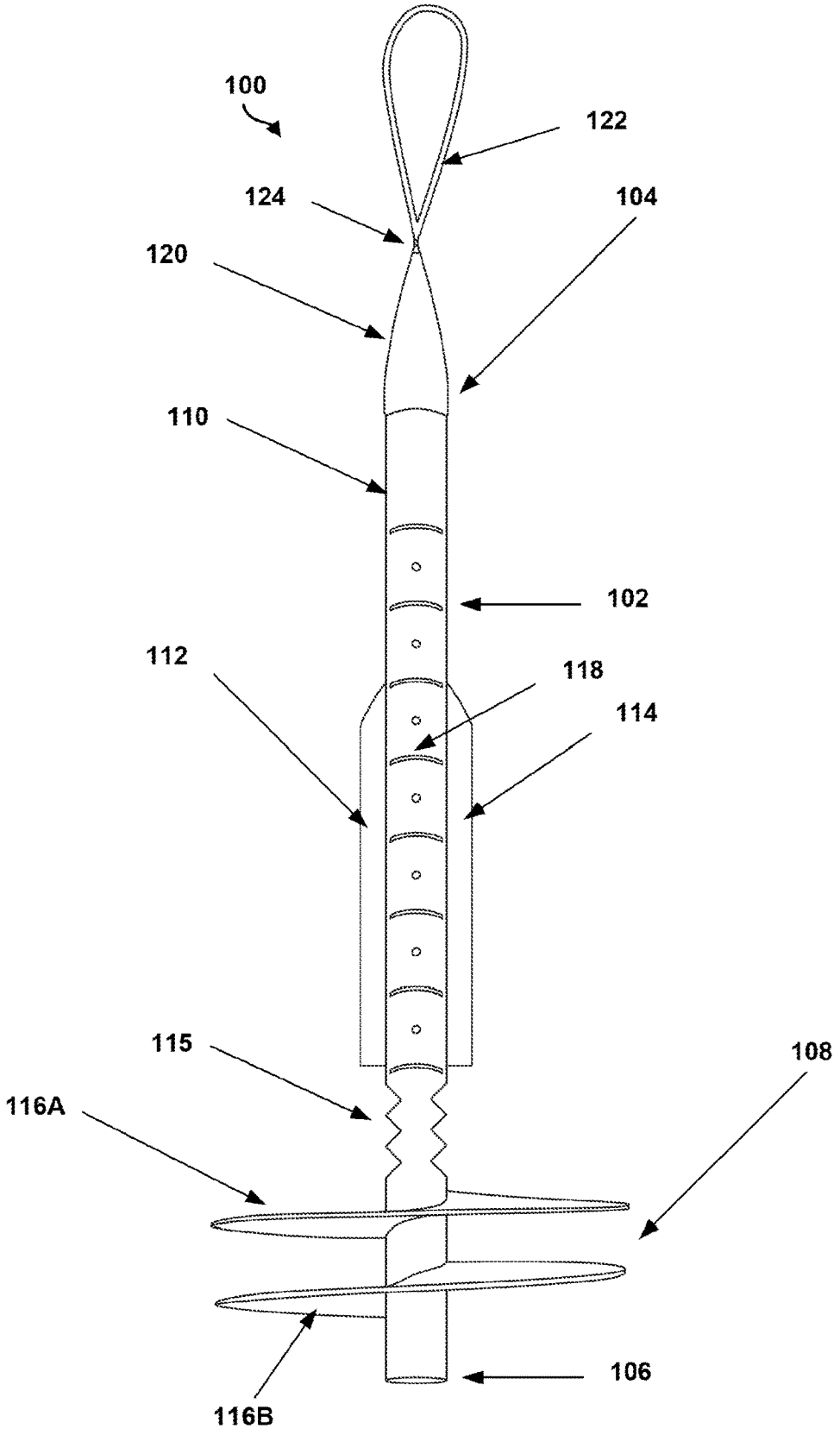
FIG. 1 illustrates a side view of a device, according to an example embodiment.

Exemplary devices, kits, systems and methods are described herein. It should be understood that the word "exemplary" is used herein to mean "serving as an example, instance, or illustration." Any embodiment or feature described herein as "exemplary" is not necessarily to be construed as preferred or advantageous over other embodiments or features. The exemplary embodiments described herein are not meant to be limiting. It will be readily understood that certain aspects of the disclosed devices, kits, systems and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an exemplary embodiment may include elements that are not illustrated in the Figures.

As used herein, with respect to measurements, "about" means +/−5%.

As used herein, "French" refers to a unit of measurement for a catheter. A round catheter of 1 French has an external diameter of ⅓ mm, and therefore the diameter of a round catheter in millimeters can be determined by dividing the French size by 3.

As used herein, "coupled" means associated directly, as well as indirectly. For example, a member A may be directly associated with a member B, or may be indirectly associated therewith, via another member C. It will be understood that not all relationships among the various disclosed elements are necessarily represented.

Unless otherwise indicated, the terms "first," "second," etc. are used herein merely as labels, and are not intended to impose ordinal, positional or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one embodiment" or "one example" means that one or more feature, structure, or characteristic described in connection with the example is included in at least one implementation. The phrases "one embodiment" or "one example" in various places in the specification may or may not be referring to the same example.

As used herein, a system, apparatus, device, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

With respect to the Figures, FIG. 1 illustrates an example device 100 including a tube 102 having a first end 104 and a second end 106. The device 100 may further include a stopper 108 coupled to a surface 110 of the tube adjacent to the second end 106 of the tube 102. The stopper 108 may be configured to extend radially from the surface 110 of the tube 102. The device 100 may further include a first rib 112 coupled to the surface 110 of the tube 102. In addition, the device may include a second rib 114 coupled to the surface 110 of the tube 102. The first rib 112 and the second rib 114 are positioned opposite one another on the surface 110 of the tube 102 between the first end 104 of the tube 104 and the stopper 108.

The tube 102 may have a length ranging from about 15 cm to about 30 cm, and the tube 102 may have a diameter ranging from about 4 mm (12 French) to about 8 mm (24 French). The length of the tube 102 accommodates variable thickness abdominal walls to hold the tube 102 securely in place when in use. The length of the intra-gastric portion of the tube 102 may range from about 1 cm to about 3 cm. The first rib 112 and the second rib 114 may have a length (in a direction parallel to a longitudinal axis of the tube) ranging from about 10 cm to about 15 cm, a width (in a direction perpendicular to a longitudinal axis of the tube) ranging from about 4 mm to about 8 mm, and a thickness ranging from about 1 mm to about 3 mm. In one example, the tube 102 has an adjustable length. In particular, as shown in FIG. 1, a portion 115 of the tube 102 between the stopper 110 and the first and second ribs 112, 114 may be adjustable. Other portions of the tube 102 may be adjustable as well. In such examples, the tube 102 may include a helical section, an accordion section, or a coiled section that are able to expand or contract in response to a force (e.g., push-pull force). Other example expandable configurations are possible as well. Such an adjustable length of the tube 102 enables a single tube to work for a variety of patients with a variety of sized abdominal walls. In yet another example, the tube 102 has a first lumen and a second lumen that is separate from the first lumen. In such an example, a gastronomy tube may be positioned in the first lumen and a jejunostomy tube may be positioned in the second lumen. Other example tubes positioned in the first and second lumens are possible as well.

In one example, the tube 102 comprises a material capable of being compressed and returned to an original shape, including, but not limited to, a polymer material such as PLGA (poly-pactic-co-glycolic acid), PCL (poly-caprolactone) or PMMA (poly-methyl-methacrylate), rubber, silicone or combinations thereof. In one example, the first and second ribs 112, 114 and/or the stopper 108 may comprise the same material as the tube 102. In another example, the first and second ribs 112, 114 and/or the stopper 108 may comprise a different material than the tube 102. For example, the first and second ribs 112, 114 may comprise a more flexible material than the other components of the device 100. In yet another example, the stopper 108 may comprise a less flexible material than the other components of the device 100. Other examples are possible as well.

The stopper 108 may be configured to sit within the stomach and hold the stomach against the abdominal wall. The stopper 108 is configured to resist external dislodgment forces, yet may be flexible enough to allow the tube 102 to be extracted when it is no longer needed. The stopper 108 may be composed of a radio-opaque material such that computed tomography imaging or fluoroscopy can delineate how much of the tube 102 is positioned within the stomach if concern about extraction exists or to confirm accurate placement.

In one particular example, the stopper 108 comprises a single helical blade. In another example, as shown in FIG. 1, the stopper 108 comprises two helical blades 116A, 116B. In such examples, the helical blade(s) 116A, 116B may be flexible. The helical blade(s) 116A, 116B may have a diameter of about 25 mm and a length of about 2.5 mm, for example. In another example, the stopper 108 comprises a flange having a rounded dome defining a cavity arranged such that the dome faces the first end 104 of the tube 102 and the cavity faces the second end 106 of the tube 102. In yet another example, the stopper 108 comprises an inflatable balloon that may be inflated and expand radially once the second end 106 of the tube 102 is positioned in the stomach of the patient. Other example stoppers are possible as well.

In one example, the first rib 112 and the second rib 114 are configured to be pierceable, as discussed in additional detail below. In another example, the first rib 112 and the second rib 114 include a plurality of through-holes. In another example, the first rib 112 and the second rib 114 each include a single channel. Further, the first rib 112 and the second rib 114 may be tapered at one end arranged nearest the first end 104 of the tube 102, as shown in FIG. 1. Having the end of the ribs 112, 114 nearest the first end 104 of the tube 102 tapered may enable easier removal of the tube 102 from a patient after use. In another embodiment, the first rib 112 and the second rib 114 may be tapered at the end arranged nearest the second end 106 of the tube 102.

The device 100 may further include a plurality of measurement markings 118 on the surface 110 of the tube 102. These measurement markings 118 may provide an indication to a medical professional of a depth of the tube 102 within the patient. The device 100 may further include a conical tip 120 coupled to the first end 104 of the tube 102, and a loop 122 coupled to a tapered end 124 of the conical tip 120. This configuration may be used to assist in percutaneous placement and removal of the device 100. In particular, during placement of the device 100, the device 100 is positioned in the mouth of the patient and down the throat into the stomach. Once the device 100 is located in the stomach of the patient, the medical professional makes a small incision to provide an access cite to the stomach from outside of the patient. The medical professional then snags the loop 122 of the device 100 through the access site, and pulls the device 100 through the access site. The stopper 108 then abuts the abdominal wall from inside the stomach of the patient, thereby preventing the device 100 from being pulled completely out of the stomach of the patient.

Figure 2:
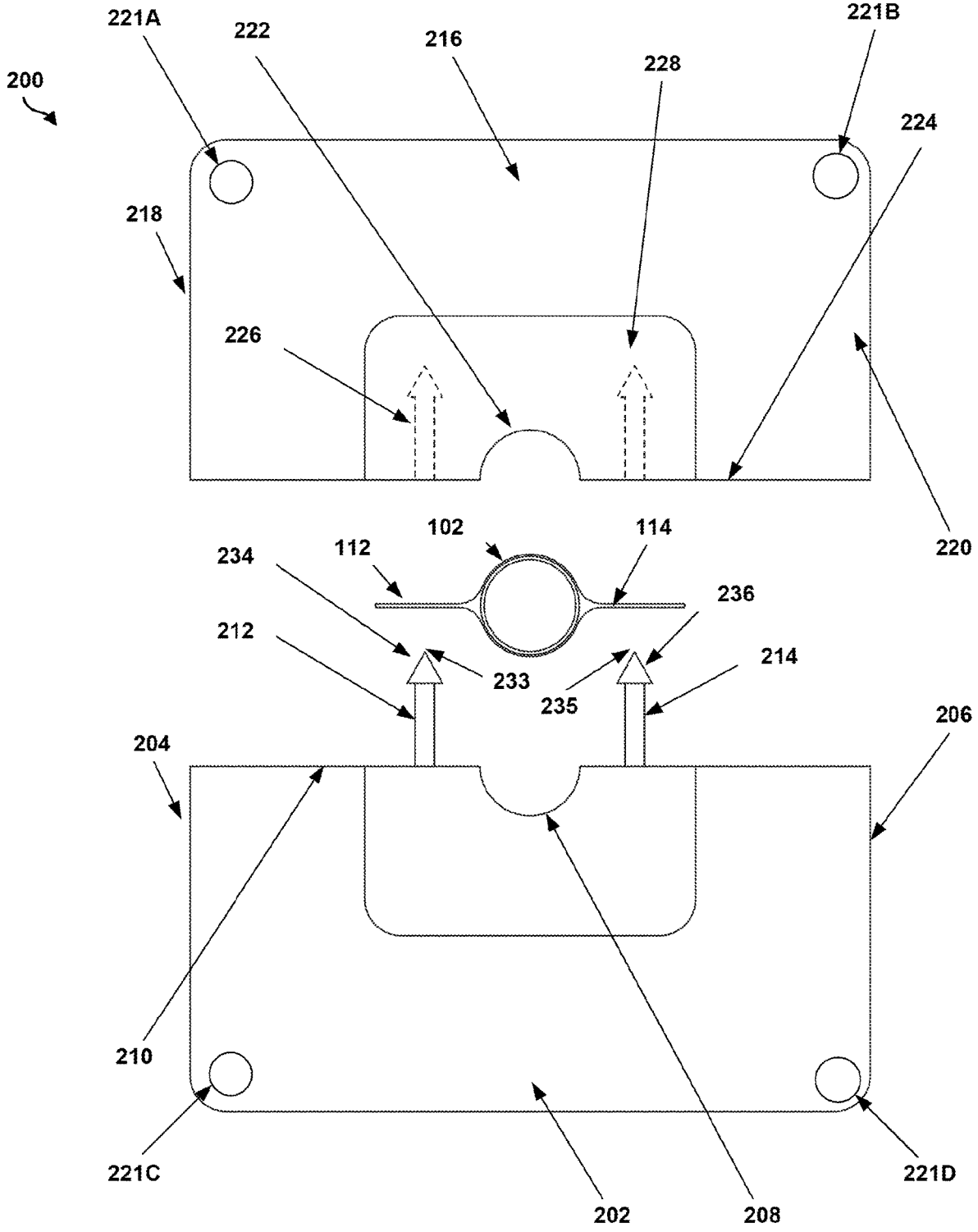
FIG. 2 illustrates a top view of a locking mechanism, according to an example embodiment.

The device 100 described above and shown in FIG. 1 may be secured against the abdominal wall by a locking mechanism 200 as shown in FIGS. 2-6. In particular, as shown in FIG. 2, the locking mechanism 200 may include a first component 202 having a first end 204 and a second end 206. The first component 202 may include a first depression 208 on a mating face 210 of the first component 202. The first component 202 may also include a first protrusion 212 coupled to the mating face 210 of the first component 202 and positioned between the first depression 208 and the first end 204 of the first component 202. The first component 202 may also include a second protrusion 214 coupled to the mating face 210 of the first component 202 and positioned between the first depression 208 and the second end 204 of the first component 202. The locking mechanism 200 may further include a second component 216 having a first end 218 and a second end 220, and may include a second depression 222 on a mating face 224 of the second component 216. The second component 216 may also include a first cavity 226 arranged on the mating face 224 of the second component 216 and positioned between the second depression 222 and the first end 218 of the second component 216. In use, the first cavity 226 is configured to receive the first protrusion 212. The second component 216 may also include a second cavity 228 arranged on the mating face 224 of the second component 216 and positioned between the second depression 222 and the second end 220 of the second component 216. In use, the second cavity 228 is configured to receive the second protrusion 214.

In another example, the first component 202 may include a first protrusion 212 coupled to the mating face 210 of the first component 202 and positioned between the first depression 208 and the first end 204 of the first component 202. The first component 202 may also include a first cavity 226 arranged on the mating face 210 of the first component 202 and positioned between the first depression 208 and the second end 204 of the first component 202. In such an example, the second component 216 may also include a second protrusion 214 arranged on the mating face 224 of the second component 216 and positioned between the second depression 222 and the first end 218 of the second component 216. The second component 216 may also include a second cavity 228 arranged on the mating face 224 of the second component 216 and positioned between the second depression 222 and the second end 220 of the second component 216. In use, the first cavity 226 is configured to receive the first protrusion 212 and the second cavity 228 is configured to receive the second protrusion 214.

In one example, a system is provided that includes the device 100, as described above, coupled to the locking member 200, as described above. Specifically, the first protrusion 212 is configured to pierce the first rib 112 and is positioned at least partially within the first cavity 226 and the second protrusion 214 is configured to pierce the second rib 114 and is positioned at least partially within the second cavity 228. In addition, the first depression 208 and the second depression 222 are positioned around the surface 110 of the tube 102 such that the mating face 210 of the first component 202 contacts the mating face 224 of the second component 216.

In another example, the first rib 112 and the second rib 114 include a plurality of through-holes. In such an example, the first protrusion 212 is configured to be positioned through one of the plurality of through-holes of the first rib 112 and is positioned at least partially within the first cavity 226. The second protrusion 214 is likewise configured to be positioned through one of the plurality of through-holes of the second rib 114 and is positioned at least partially within the second cavity 228. And the first depression 208 and the second depression 222 are positioned around the surface 110 of the tube 102 such that the mating face 210 of the first component 202 contacts the mating face 224 of the second component 216.

In another example, the first rib 112 and the second rib 114 each include a single channel. In such an example, the first protrusion 212 is configured to be positioned through the single channel of the first rib 112 and is positioned at least partially within the first cavity 226, the second protrusion 214 is configured to be positioned through the single channel of the second rib 114 and is positioned at least partially within the second cavity 228, and the first depression 208 and the second depression 222 are positioned around the surface 110 of the tube 102 such that the mating face 210 of the first component 202 contacts the mating face 224 of the second component 216.

In yet another example, the first rib 112 and the second rib 114 are configured to be pinched between the mating face 210 of the first component 202 and the mating face 224 of the second component 216. In such an example, the first depression 208 and the second depression 222 are positioned around the surface 110 of the tube 102. Further, a first portion of the mating face 210 of the first component 202 contacts a first side of the first rib 112, and a first portion of the mating face 224 of the second component 216 contacts a second side of the first rib 112 to thereby pinch the first rib 112 between the mating face 210 of the first component 202 and the mating face 224 of the second component 216. Further, a second portion of the mating face 210 of the first component 202 contacts a first side of the second rib 114, and a second portion of the mating face 224 of the second component 216 contacts a second side of the second rib 114 to thereby pinch the second rib 114 between the mating face 210 of the first component 202 and the mating face 224 of the second component 216.

In one example, the first component 202 and the second component 216 each have a length ranging from about 25 mm to about 40 mm. Further, the first component 202 and the second component 216 independently range in width from about 10 mm to about 40 mm. In one example, the width of the first component 202 is equal to the width of the second component 216. In another example, the width of the first component 202 is different than the width of the second component 216. For example, the first component 202 may have a width ranging from about 25 mm to about 40 mm, and the width of the second component 216 may have a width ranging from about 10 mm to about 25 mm. Further, the first component 202 and the second component 216 each have a width ranging from about 10 mm to about 15 mm. In addition, the first depression 208 and the second depression 222 each have a diameter ranging in size from about 4 mm to about 10 mm to accept tubes ranging from, but not limited to, 12 French to 24 French size. In one example, the bottom surface 230 of the first component 202 and the bottom surface 232 of the second component 216 include an adhesive, which may be used to further secure the locking mechanism 200 to the stomach of the patient when the system is in use. In another example, the first component 202 may include through holes 221A, 221B and the second component may include through holes 221C, 221D, through which a suture 223 can be placed to further secure the location of the locking device 200 to the skin of the patient. Such an arrangement further secures the locking mechanism 200 to the skin of the patient and helps to prevent extraction when changing caps 300.

As described above, when in use, the first protrusion 212 is configured to be positioned at least partially within the first cavity 226, and the second protrusion 214 is positioned at least partially within the second cavity 228 such that the first component 202 and the second component 216 are coupled to one another to form a collar 203 around a tube 102 that has been placed at least partially in vivo. The coupling of the first component 202 to the second component 216 may be a permanent coupling, such that once the first protrusion 212 is positioned within the first cavity 226 and the second protrusion 214 is positioned within the second cavity 228, the protrusions 212, 214 cannot be removed from the cavities 226, 228. In such an example, the entire device 100 and locking mechanism 200 system may be pulled in a direction away from the body of the patient to remove the tube 102 when the tube 102 is no longer needed, and the entire system is discarded. In another example, the coupling of the first component 202 to the second component 216 may be a temporary coupling such that the first component 202 can be separated from the second component 216 after use. In such an example, only the tube 102 is discarded, and the locking mechanism 200 can be reused.

In one example, as shown in FIG. 2, a free end 233 of the first protrusion 212 has a first radially extending rim 234 and a free end 235 of the second protrusion 214 has a second radially extending rim 236. In such an example, the first protrusion 212 is configured to pierce the first rib 112 of the device 100, and the first cavity 226 is configured to receive the first protrusion 212 and engage the first radially extending rim 234. Similarly, the second protrusion 214 is configured to pierce the second rib 114 of the device 100, and the second cavity 228 is configured to receive the second protrusion 214 and engage the second radially extending rim 236 to thereby lock the first component 202 to the second component 216 to form a collar 203 around the tube 102.

Figure 3:
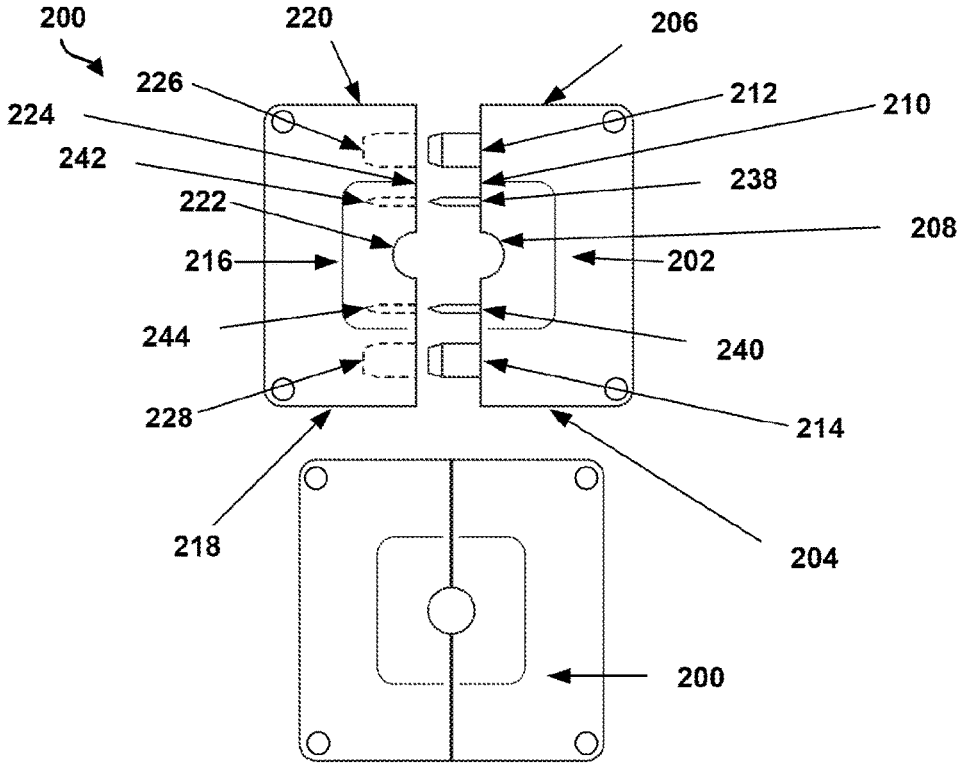
FIG. 3 illustrates a top view of another locking mechanism in an open position and a closed position, according to an example embodiment.

In another example, as shown in FIG. 3, the first component 202 may further include a third protrusion 238 coupled to the mating face 210 of the first component 202 and positioned between the first depression 208 and the first protrusion 212, and a fourth protrusion 240 coupled to the mating face 210 of the first component 202 and positioned between the first depression 208 and the second protrusion 214. In such an example, the second component 216 further includes a third cavity 242 within the mating face 224 of the second component 216 and positioned between the second depression 222 and the first cavity 226. In this arrangement, the third cavity 242 is configured to receive the third protrusion 238. The second component 216 further includes a fourth cavity 244 within the mating face 224 of the second component 216 and positioned between the second depression 222 and the second cavity 228. In this arrangement, the fourth cavity 244 is configured to receive the fourth protrusion 240.

In operation, the first component 202 may be snap-fit to the second component 216 via the first protrusion 212 interacting with the first cavity 226 and the second protrusion 214 interacting with the second cavity 228. As such, the first and second depressions 208, 222 of the locking mechanism 200 are configured to be positioned around the surface 110 of the tube 102 such that the mating face 210 of the first component 202 contacts the mating face 224 of the second component 216 after the tube 102 has been placed at least partially in vivo. The third protrusion 238 is configured to pierce the first rib 112 of the device 100, and the third cavity 242 is configured to receive the third protrusion 238. Similarly, the fourth protrusion 240 is configured to piece the second rib 114 of the device 100, and the fourth cavity 244 is configured to receive the fourth protrusion 240.

Figure 4:
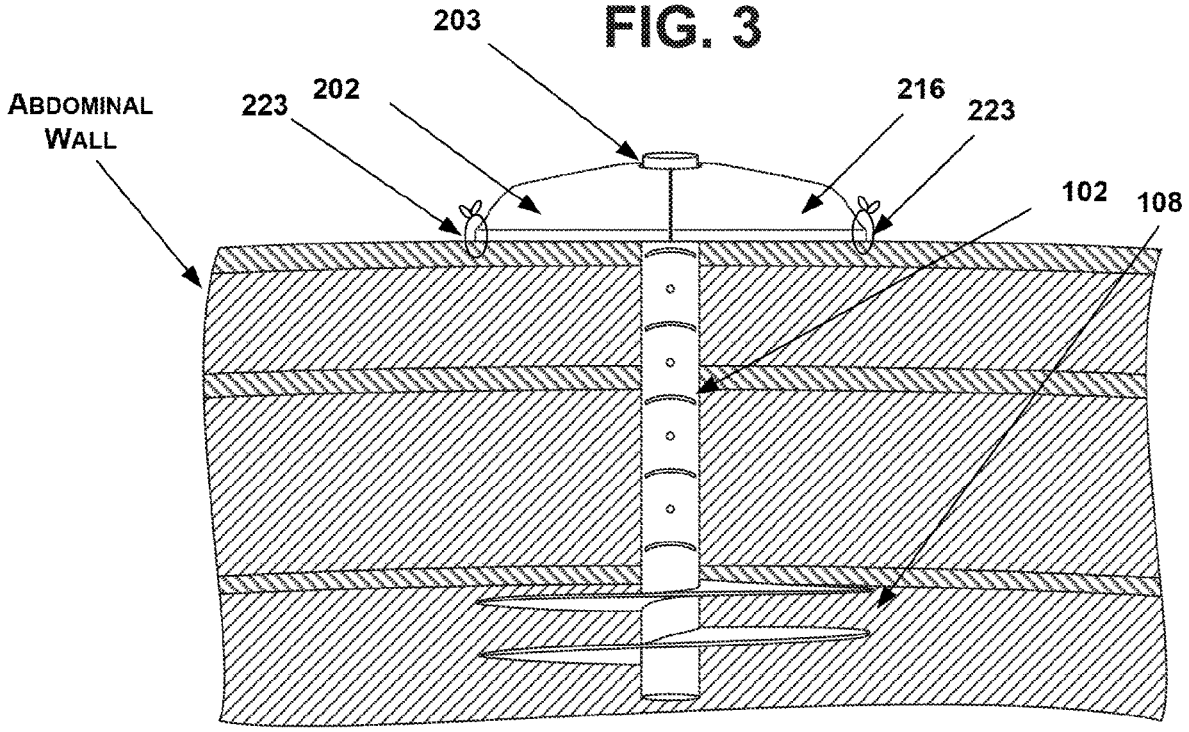
FIG. 4 illustrates the locking mechanism of FIG. 3 positioned around a tube, according to an example embodiment.

In such an example, the present disclosure provides a system comprising the device 100 as described above coupled to the locking member 200 as just described in relation to FIG. 3, where the first protrusion 212 is positioned at least partially within the first cavity 226, where the second protrusion 214 is positioned at least partially within the second cavity 228, where the third protrusion 238 pierces the first rib 112 and is positioned at least partially within the third cavity 242, where the fourth protrusion 240 pierces the second rib 114 and is positioned at least partially within the fourth cavity 244, and where the first depression 108 and the second depression 222 are positioned around the surface 110 of the tube 102 such that the mating face 210 of the first component 202 contacts the mating face 224 of the second component 216. Such an arrangement is illustrated in FIG. 4. The tube 102 can be cut flush with the top of the locking mechanism 200 to help prevent dislodgement of the tube 102 for the patient, as shown in FIG. 4.

Figure 5A:
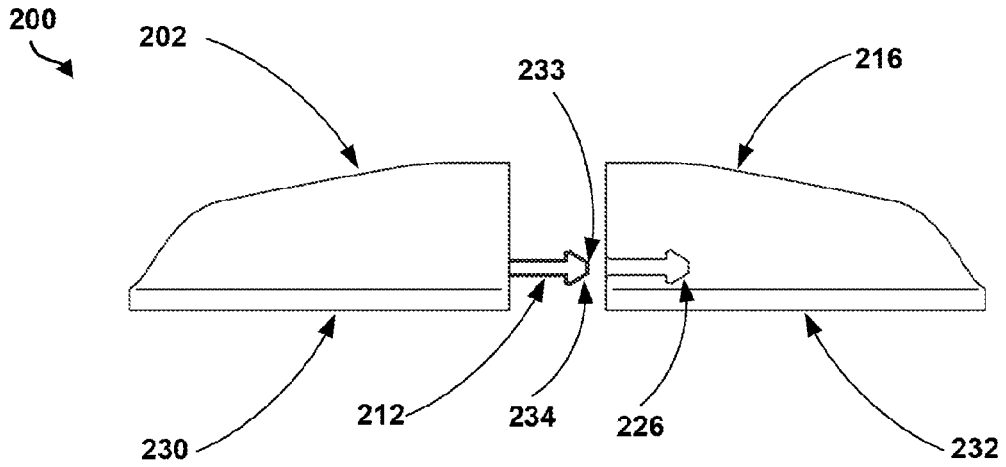
FIG. 5A illustrates a side view of another locking mechanism, according to an example embodiment.
Figure 5B:
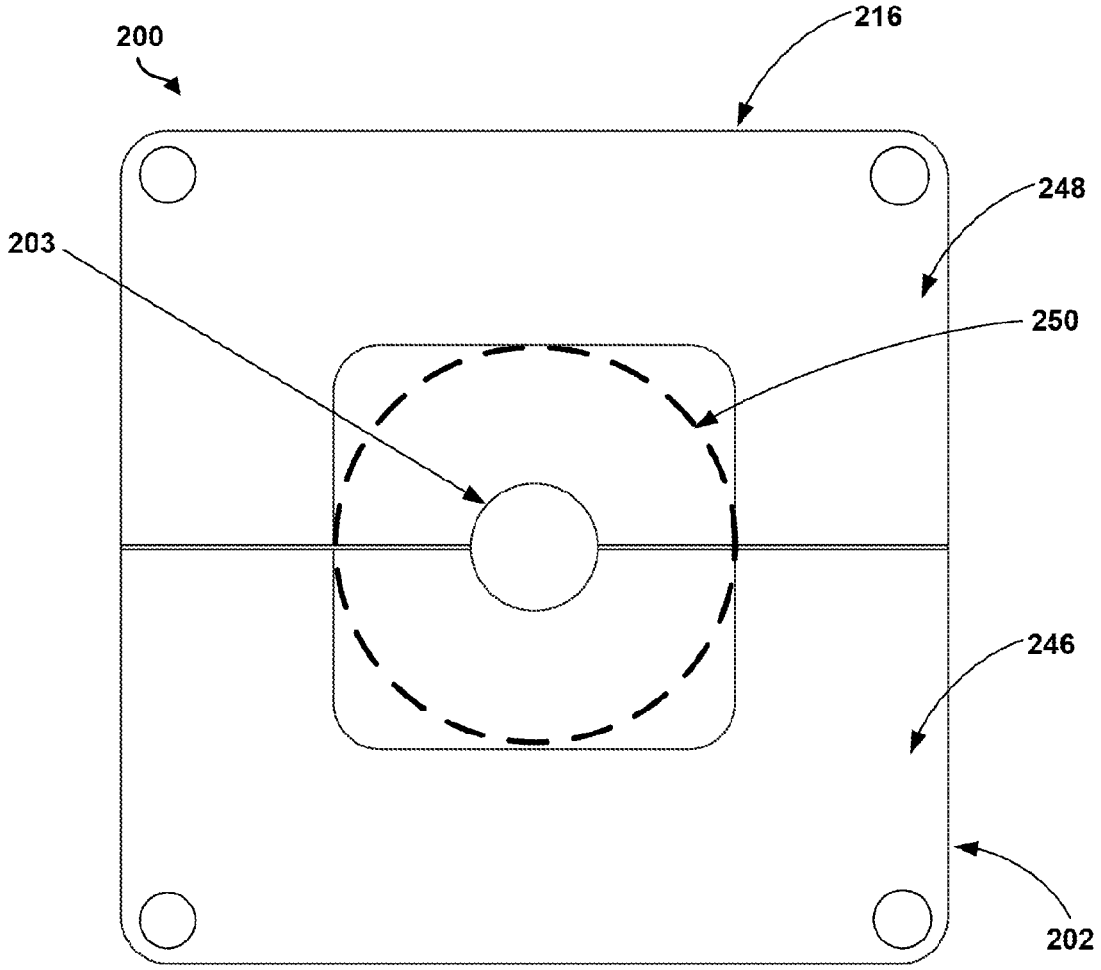
FIG. 5B illustrates a top view of the locking mechanism of FIG. 5A, according to an example embodiment.

FIG. 5A illustrates a side view of the locking mechanism 200, particularly illustrating the free end 233 of the first protrusion 212 with a first radially extending rim 234, and the first cavity 226 is shown configured to receive the first protrusion 212 and engage the first radially extending rim 234. FIG. 5B illustrates a top view of the locking mechanism 200 when the first and second components 202, 216 are joined together to form a collar 203 around the tube 102.

In one example, an outer portion 246 of the first component 202 and an outer portion 248 of the second component 216 are rotatable with respect to the first protrusion 212 and the second protrusion 214 when the first protrusion 212 is positioned in the first cavity 226 and the second protrusion 214 is positioned in the second cavity 228. Such an arrangement may help relieve tension and/or tugging on the tube 102 as the patient moves. In one particular example, as shown in FIG. 5B, the first and second components 202, 216 include a ball bearing system 250 that enables the outer portion 246 of the first component 202 and the outer portion 248 of the second component 216 to rotate with respect to the first protrusion 212 and the second protrusion 214 when the first protrusion 212 is positioned in the first cavity 226 and the second protrusion 214 is positioned in the second cavity 228. Other mechanisms to enable rotation are possible as well.

Figure 6:
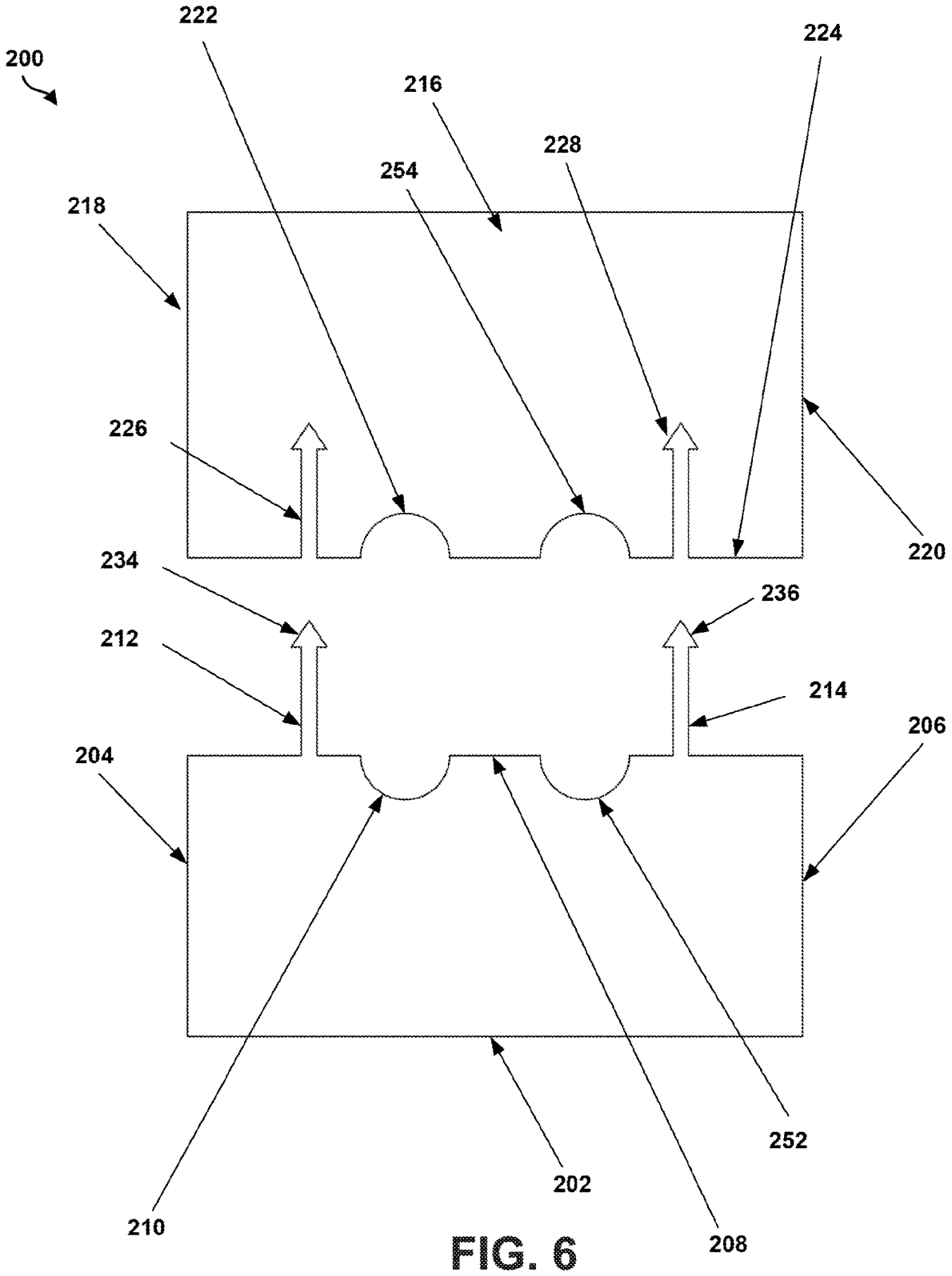
FIG. 6 illustrates a top view of another locking mechanism, according to an example embodiment.

FIG. 6 illustrates another embodiment of the locking mechanism 200. As shown in FIG. 6, the first component 202 may further comprise a third depression 252 on the mating face 208 of the first component 202, and the second component 216 may further comprise a fourth depression 254 on the mating face 224 of the second component 216. In such an example, a gastronomy tube may be positioned between the first depression 208 and the second depression 220 when the first component 202 and the second component 216 are locked together, and a jejunostomy tube may be positioned between the third depression 252 and the fourth depression 254. Other example tubes are possible as well. In one example, the radius of each of the first depression 208, the second depression 222, the third depression 252, and the fourth depression 254 are the same. In another example, a radius of the first depression 208 and the second depression 222 are the same, and the radius of the third depression 252 and the fourth depression 254 are the same, but the radius of the first depression 208 and second depression 222 is different than the radius of the third depression 252 and the fourth depression 254.

There are several advantages to the design of the system of the device 100 and locking mechanism 200 as described above, including (i) the accommodation of variable abdominal wall thicknesses, (ii) the tube 102 may be cut flush with the locking mechanism 200 to prevent external forces from inadvertently pulling it out, and (iii) the locking mechanism 200 has a low profile to further protect the integrity of the placement of the tube 102.

Figure 7A:
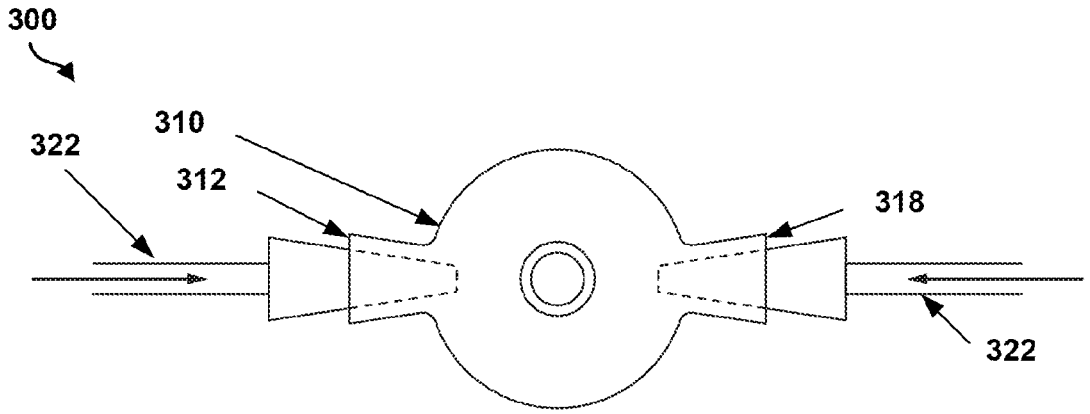
FIG. 7A illustrates a top view of an example cap, according to an example embodiment.

The present disclosure also provides a cap 300, as shown in FIGS. 7A-10B. In particular, as shown in FIGS. 7A-7B, the cap 300 may include a tubular structure 302 having a first end 304 and a second end 306. The tubular structure 302 defines a lumen 308. The cap 300 may also include a flange 310 coupled to the second end 306 of the tubular structure 302. In one embodiment, the flange 310 is circular. In another embodiment, the flange 310 is square. The flange 310 may be shaped to match a shape of the locking mechanism 200 described above. Other arrangements are possible as well. The cap 300 may also include a first input port 312 coupled to the flange 310. The cap 300 may also include a first channel 314 defined in the flange 310 and configured to provide fluid connection between the first input port 312 and the tubular structure 302.

The tubular structure 302 may have a diameter ranging from about 2 mm to about 5 mm. The flange 310 may have a thickness ranging from about 15 mm to about 30 mm, and a width ranging from about 30 mm to about 40 mm. The cap 300 may comprise a material having shape memory, including, but not limited to, a polymer material such as PLGA (poly-pactic-co-glycolic acid), PCL (poly-caprolactone) or PMMA (poly-methyl-methacrylate), rubber, silicone or combinations thereof.

Figure 7B:
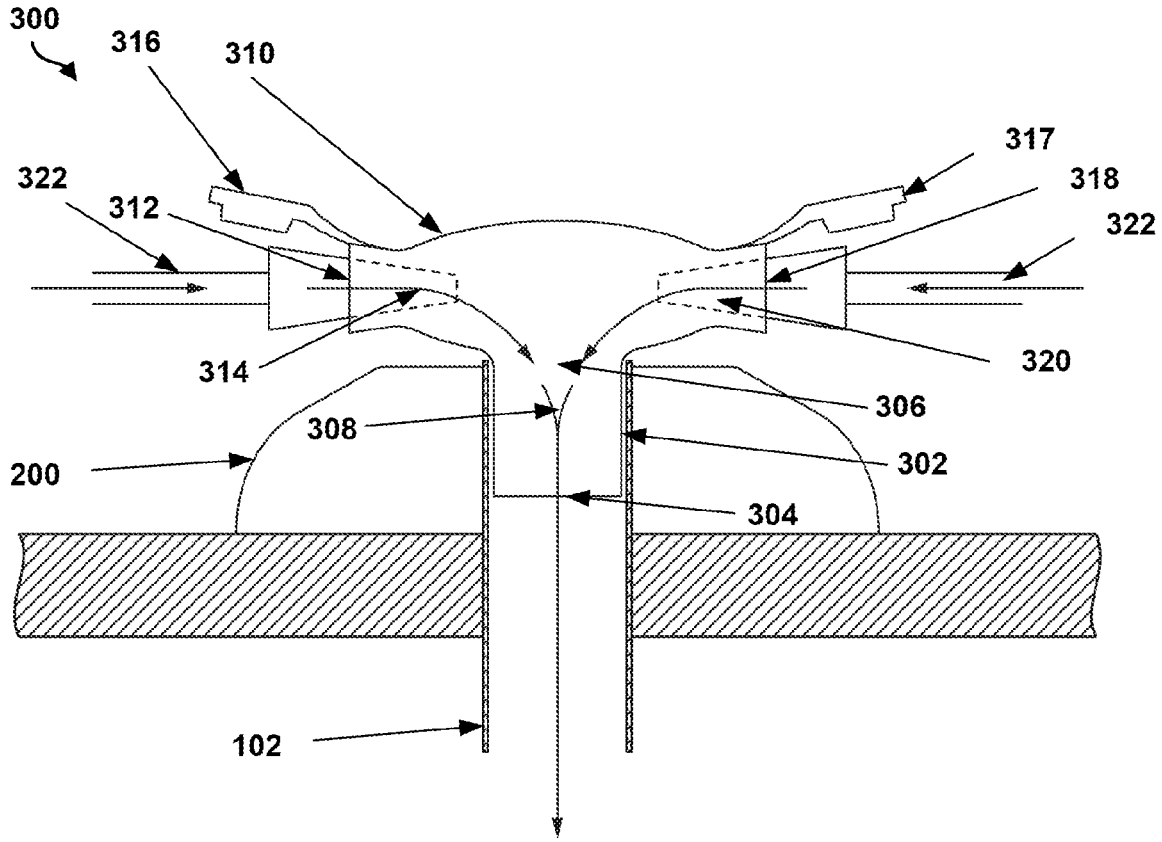
FIG. 7B illustrates a side view of the cap of FIG. 7A, according to an example embodiment.

As shown in FIGS. 7A-7B, the cap may further include a second input port 318 coupled to the flange 310, and a second channel 320 defined in the flange 310 and configured to provide fluid connection between the second input port 318 and the tubular structure 302. Such an arrangement may enable a practitioner to provide two substances to the stomach of the patient at the same time (e.g., both medication and food). In one example, the longitudinal axis of the lumen 308 is perpendicular to the longitudinal axis of the first channel 314, and the longitudinal axis of the first channel is parallel to the longitudinal axis of the second channel 320. Such an arrangement may provide a low-profile system when tubes 322 are positioned in the first input port 312 and the second input port 318, as shown in FIG. 7B.

In another embodiment, the cap 300 may also include a first plug 316 removably positioned in the first input port 312 to thereby close access to the first channel 314, as shown in FIG. 7B. Further, the cap 300 may include a second plug 317 removably positioned in the second input port 318 to thereby close access to the second channel 320. In one example, the first plug 316 and/or the second plug 317 are permanently coupled to the flange 310 and/or are created integrally as a single piece with the flange 310.

Figure 8A:
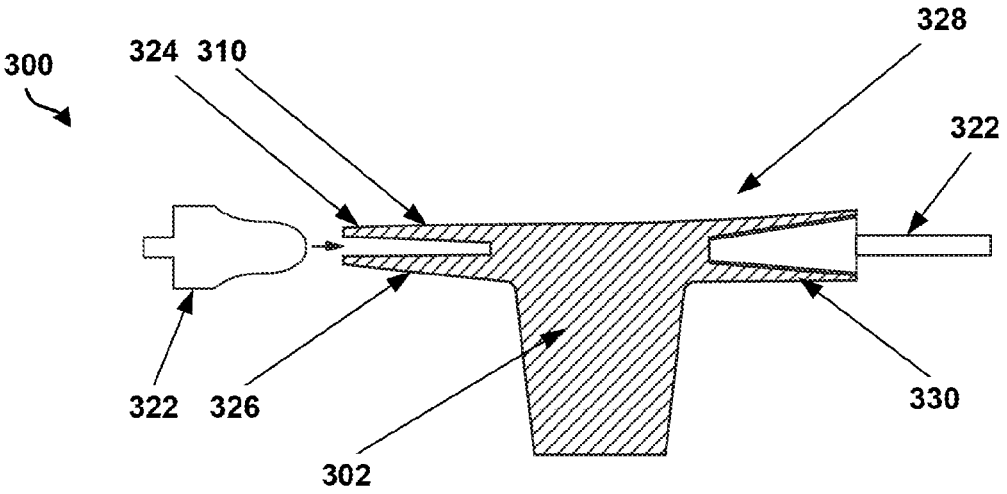
FIG. 8A illustrates a cross-sectional side view of another example cap, according to an example embodiment.
Figure 8B:
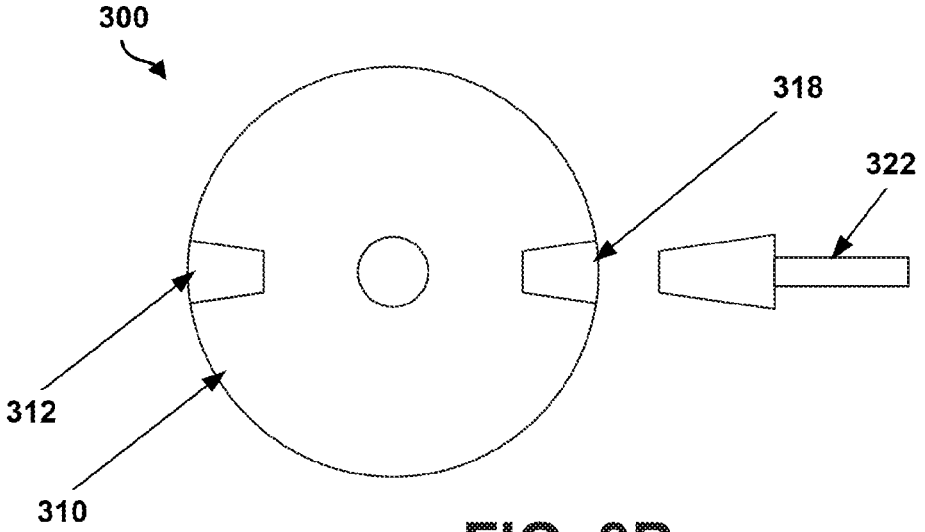
FIG. 8B illustrates a top view of the cap of FIG. 8A, according to an example embodiment.
Figure 8C:
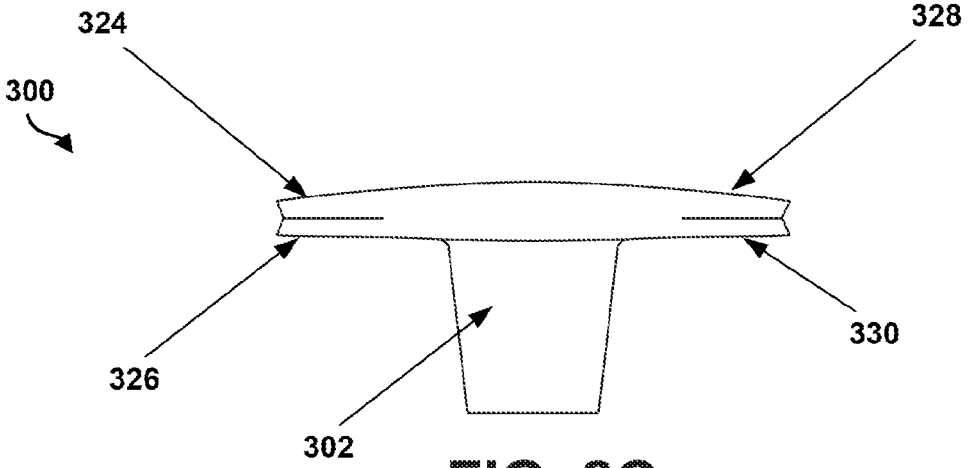
FIG. 8C illustrates a side view of the cap of FIG. 8A, according to an example embodiment.

In one embodiment, the flange 310 is closed to an environment surrounding the cap 300 other than via the first input port 312 and the tubular structure 302. Further, the first input port 312 may be configured to be reversibly opened and closed. In one such embodiment, the first input port 312 may comprise an upper portion 324 and a lower portion 326, as shown in FIG. 8A. The upper portion 324 and the lower portion 326 may contact one another to thereby close access to the first channel 314 in a first position, and the upper portion 324 and the lower portion 326 may be configured to separate from each other in a second position when a tube 322 is inserted into the first input port 312. Further, as shown in FIG. 8A, the cap 300 may include a second input port 318 similarly configured to the first input port 312, including a second channel 320 defined in the flange 310. The second input port 318 may include an upper portion 328 and a lower portion 330, as shown in FIG. 8A. The upper portion 328 and the lower portion 330 may contact one another to thereby close access to the second channel 320 in a first position, and the upper portion 328 and the lower portion 330 may be configured to separate from each other in a second position when a tube 322 is inserted into the second input port 318.

Figure 9A:
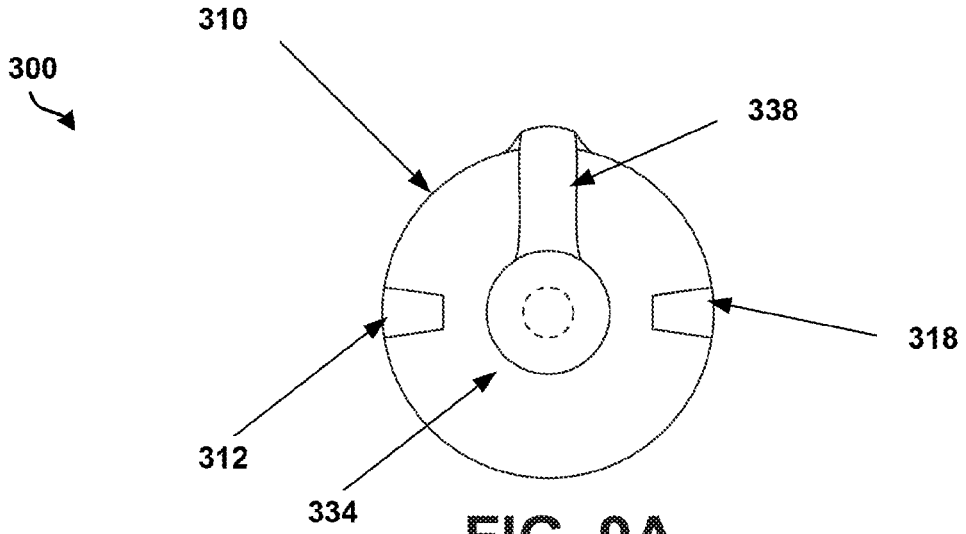
FIG. 9A illustrates a top view of another example cap, according to an example embodiment.
Figure 9B:
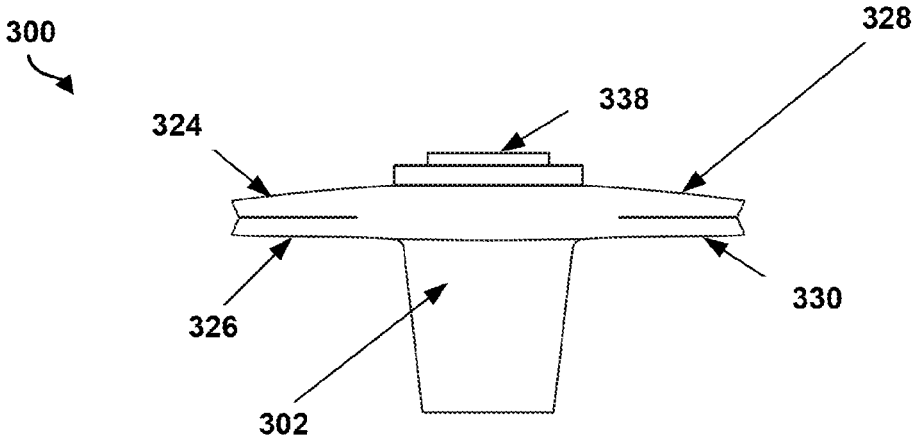
FIG. 9B illustrates a side view of the cap of FIG. 9A, according to an example embodiment.
Figure 9C:
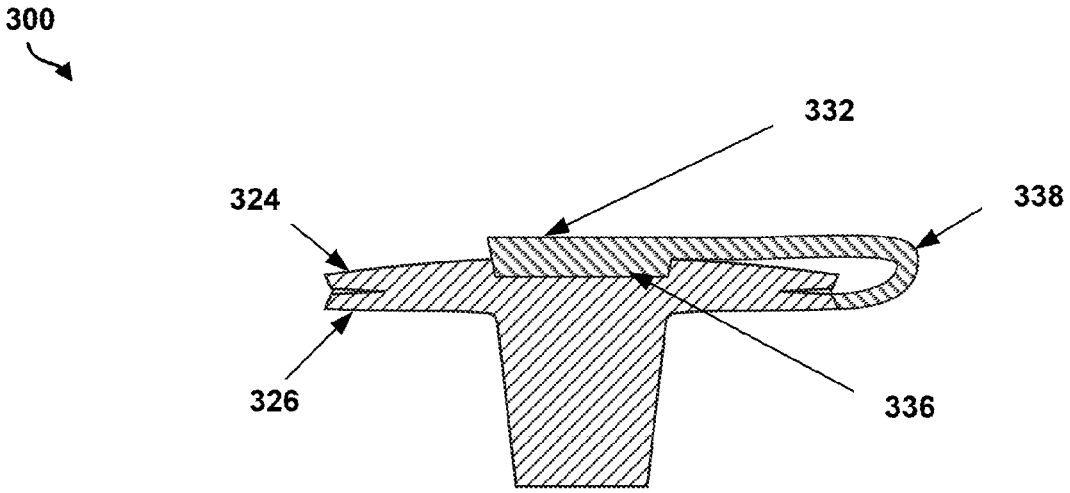
FIG. 9C is a side cross-sectional view of the cap of FIG. 9A, according to an example embodiment.

In another embodiment, as shown in FIGS. 9A-9C, the cap 300 may further include a third input port 332 positioned on a top surface 334 of the flange 310, and a third channel 336 defined in the flange 310 and configured to provide fluid connection between the third input port 332 and the tubular structure 302. In one example, the longitudinal axis of the third channel 336 is parallel to the longitudinal axis of the lumen 308. In such an example, the cap 300 may include a third plug 338 removably positioned in the third input port 332 to thereby close access to the third channel 336. In one example, the third plug 338 is permanently coupled to the flange 310 and/or is created integrally as a single piece with the flange 310.

Figure 10A:
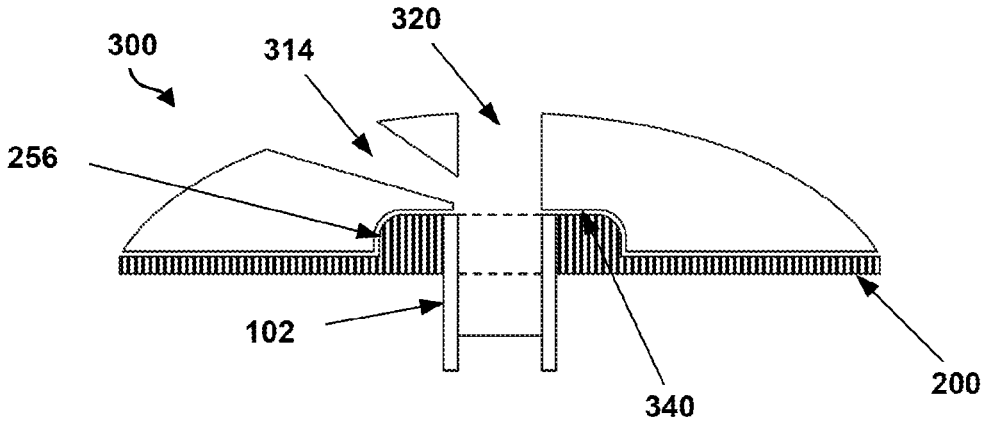
FIG. 10A is a side cross-sectional view of another cap, according to an example embodiment.
Figure 10B:
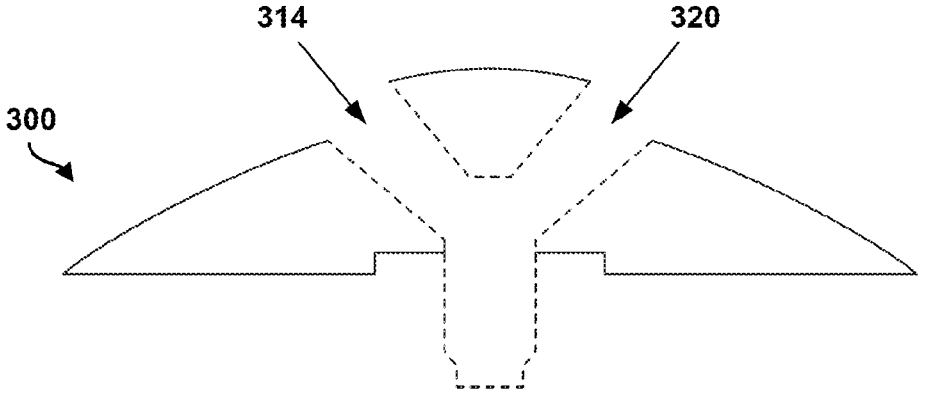
FIG. 10B is a side cross-sectional view of another cap, according to an example embodiment.

In one particular example, as shown in FIG. 10A, the locking mechanism 200 may include a vertically extending portion 256 configured to fit within a cutout portion 340 of the flange 310. Such an arrangement may provide an improved low profile design to accept the cap 300. In one embodiment, the longitudinal axis of the lumen 308 of the tubular structure 102 is perpendicular to the longitudinal axis of the first channel 314, as shown in FIG. 7B. In another embodiment, the longitudinal axis of the lumen 308 of the tubular structure 102 is positioned at an acute angle with respect to the longitudinal axis of the first channel 314, as shown in FIGS. 10A and 10B. Further, as shown in FIGS. 10A and 10B, the longitudinal axis of the second channel 320 may be positioned parallel to the longitudinal axis of the lumen 308 (as shown in FIG. 10A) or the longitudinal axis of the second channel 320 may be positioned at an acute angle with respect to the longitudinal axis of the lumen 308 (as shown in FIG. 10B).

In yet another example, the tubular structure 302 of the cap has a first lumen and a second lumen that is separate from the first lumen. In such an example, the first channel 314 may be in fluid communication with the first lumen, and the second channel 320 may be in fluid communication with the second lumen. As such, a gastronomy tube may be positioned in the first lumen and a jejunostomy tube may be positioned in the second lumen. Other example tubes positioned in the first and second lumens are possible as well.

In use, the tube 102 may be cut flush with the locking mechanism 200 to prevent external forces from inadvertently pulling the tube 102 out of the body of the patient. Once the tube 102 has been cut flush with the locking mechanism 200, the tubular structure 302 of the cap 300 may be press fit into the tube 102. The cap 300 may then provide one or more access ports into which a practitioner can provide food, medication, or other fluids to the stomach of the patient. The cap 300 is designed such that the tubes positioned in the cap 300 remain with a low profile, thereby protecting the integrity of the placement of the tube 102.

In another embodiment, the a kit is provided that includes (i) the device 100 as described above in relation to FIG. 1 and (ii) the locking mechanism 200 as described above in relation to FIGS. 2-6. In another embodiment, a kit is provided that includes (i) the locking mechanism 200 as described above in relation to FIGS. 2-6 and (ii) the cap 300 as described above in relation to FIGS. 7A-10B. In yet another embodiment, a kit is provided that includes (i) the device 100 as described above in relation to FIG. 1, (ii) the locking mechanism 200 as described above in relation to FIGS. 2-6 and (iii) the cap 300 as described above in relation to FIGS. 7A-10B.

In another embodiment, a system is provided that includes the device 100 as described above in relation to FIG. 1 coupled to the locking mechanism 200 as described above in relation to FIGS. 2-6. In this arrangement, the first protrusion 212 is positioned at least partially within the first cavity 226, the second protrusion 214 is positioned at least partially within the second cavity 228, and the first depression 208 and the second depression 222 are positioned around the surface 110 of the tube 102 such that the mating face 210 of the first component 202 contacts the mating face 224 of the second component 216. In one example, the first rib 112 and the second rib 114 are configured to be pinched between the mating face 210 of the first component 202 and the mating face 224 of the second component 216. In such an example, a first portion of the mating face 210 of the first component 202 contacts a first side of the first rib 112, and a first portion of the mating face 224 of the second component 216 contacts a second side of the first rib 112 to thereby pinch the first rib 112 between the mating face 210 of the first component 202 and the mating face 224 of the second component 216. Further, a second portion of the mating face 210 of the first component 202 contacts a first side of the second rib 114, and a second portion of the mating face 224 of the second component 216 contacts a second side of the second rib 114 to thereby pinch the second rib 114 between the mating face 210 of the first component 202 and the mating face 224 of the second component 216. In another example, such a system may further include the cap 300 as described above in relation to FIGS. 7A-10B coupled to the device 100 as described above in relation to FIG. 1, where the tubular structure 302 is positioned at least partially in the tube 102.

In yet another embodiment, a system is provided that includes the device 100 as described above in relation to FIG. 1 coupled to the locking mechanism 200 as described above in relation to FIG. 3. In this arrangement, the first protrusion 212 is positioned at least partially within the first cavity 226, the second protrusion 214 is positioned at least partially within the second cavity 228, the third protrusion 238 pierces the first rib 112 and is positioned at least partially within the third cavity 242, and the fourth protrusion 240 pierces the second rib 114 and is positioned at least partially within the fourth cavity 244. In addition, the first depression 208 and the second depression 222 are positioned around the surface 110 of the tube 102 such that the mating face 210 of the first component 202 contacts the mating face 224 of the second component 216. In one example, such a system may farther include the cap 300 as described above in relation to FIGS. 7A-10B coupled to the device 100 as described above in relation to FIG. 1, where the tubular structure 302 is positioned in at least partially the tube 102.

While various aspects and embodiments have been disclosed herein, other aspects and embodiments will be apparent to those skilled in the art. All embodiments within and between different aspects of the invention can be combined unless the context clearly dictates otherwise. The various aspects and embodiments disclosed herein are for purposes of illustration and are not intended to be limiting, with the true scope and spirit being indicated by the claims.

The invention claimed is:

1. A device comprising:

a tube having a first end and a second end;

a stopper coupled to a surface of the tube adjacent to the second end of the tube, wherein the stopper extends radially from the surface of the tube;

a first rib coupled to the surface of the tube, wherein the first rib includes a first plurality of through-holes;

a second rib coupled to the surface of the tube, wherein the second rib includes a second plurality of through-holes, wherein the first rib and the second rib are positioned opposite one another on the surface of the tube between the first end of the tube and the stopper, wherein the first rib and the second rib are configured to be positioned perpendicular to a skin of a patient, and wherein the first plurality of through-holes and the second plurality of through-holes correspond to a plurality of depths of the tube through the skin of the patient;

a first component having a first end and a second end, the first component including a first depression on a mating face of the first component; and a second component having a first end and a second end, the second component including a second depression on a mating face of the second component, wherein the first depression and the second depression are configured to be positioned around the surface of the tube such that the mating face of the first component contacts the mating face of the second component, and wherein the first rib and the second rib of the device are configured to be pinched between the mating face of the first component and the mating face of the second component.

2. The device of claim 1, wherein the stopper comprises two helical blades.

3. The device of claim 2, wherein the two helical blades are flexible.

4. The device of claim 1, wherein the first rib and the second rib are each tapered at one end arranged nearest the first end of the tube.

5. The device of claim 1, further comprising:

a conical tip coupled to the first end of the tube; and a loop coupled to a tapered end of the conical tip.

6. The device of claim 1, wherein at least a portion of the tube has an adjustable length.

7. The device of claim 1, wherein the tube has a first lumen and a second lumen.

8. The device of claim 1, wherein the first component and the second component each have a length ranging from about 25 mm to about 40 mm.

9. The device of claim 1, wherein at least one of a bottom surface of the first component and a bottom surface of the second component includes an adhesive.

10. The device of claim 1, wherein the first component further comprises a third depression on the mating face of the first component, and wherein the second component further comprises a fourth depression on the mating face of the second component.

11. The device of claim 1, wherein the first rib and the second rib each comprise a flexible material.

12. The device of claim 1, wherein the first rib and the second rib each comprise a material that is more flexible than a material of the tube.

13. The device of claim 1, wherein the first component further comprises:

a first protrusion coupled to the mating face of the first component and positioned between the first depression and the first end of the first component; and a second protrusion coupled to the mating face of the first component and positioned between the first depression and the second end of the first component; and wherein the second component further comprises:

a first cavity arranged on the mating face of the second component and positioned between the second depression and the first end of the second component, wherein the first cavity is configured to receive the first protrusion; and a second cavity arranged on the mating face of the second component and positioned between the second depression and the second end of the second component, wherein the second cavity is configured to receive the second protrusion, wherein the first protrusion is configured to be positioned at least partially within the first cavity, and wherein the second protrusion is configured to be positioned at least partially within the second cavity.

14. The device of claim 13, wherein a free end of the first protrusion has a first radially extending rim and a free end of the second protrusion has a second radially extending rim, wherein the first cavity is configured to receive the first protrusion and engage the first radially extending rim, and wherein the second cavity is configured to receive the second protrusion and engage the second radially extending rim.

15. The device of claim 13, wherein the first protrusion is positioned at least partially within the first cavity, and wherein the second protrusion is positioned at least partially within the second cavity such that the first component and the second component are coupled to one another to form a collar.

16. The device of claim 13, wherein the first component further comprises:

a third protrusion coupled to the mating face of the first component and positioned between the first depression and the first protrusion; and a fourth protrusion coupled to the mating face of the first component and positioned between the first depression and the second protrusion; and wherein the second component further comprises:

a third cavity within the mating face of the second component and positioned between the second depression and the first cavity, wherein the third cavity is configured to receive the third protrusion; and a fourth cavity within the mating face of the second component and positioned between the second depression and the second cavity, wherein the fourth cavity is configured to receive the fourth protrusion.

17. The device of claim 16, wherein the first protrusion is positioned at least partially within the first cavity, wherein the second protrusion is positioned at least partially within the second cavity, wherein the third protrusion is positioned at least partially within the third cavity, and wherein the fourth protrusion is positioned at least partially within the fourth cavity such that the first component and the second component are coupled to one another to form a collar.

18. The device of claim 13, wherein an outer portion of the first component and an outer portion of the second component are rotatable with respect to the first protrusion and the second protrusion when the first protrusion is positioned in the first cavity and the second protrusion is positioned in the second cavity.

19. The device of claim 13, wherein the first protrusion is configured to be positioned through a first through-hole of the first plurality of through holes in the first rib, and wherein the second protrusion is configured to be positioned through a second through-hole of the second plurality of through holes in the second rib.

20. The device of claim 13, wherein the first protrusion is permanently positioned at least partially within the first cavity such that the first protrusion cannot be removed from the first cavity, and wherein the second protrusion is permanently positioned at least partially within the second cavity such that the second protrusion cannot be removed from the second cavity.

* * * * *